US008590219B2

(12) United States Patent
Meyer

(10) Patent No.: US 8,590,219 B2
(45) Date of Patent: Nov. 26, 2013

(54) RAISED ACCESS FLOOR PANEL WITH REPLACEABLE INSERT

(76) Inventor: Gary Meyer, Golden, CO (US)

( * ) Notice: Subject to any disclaimer, the term of this patent is extended or adjusted under 35 U.S.C. 154(b) by 0 days.

(21) Appl. No.: 13/284,081

(22) Filed: Oct. 28, 2011

(65) Prior Publication Data

US 2013/0104464 A1 May 2, 2013

(51) Int. Cl.
*E04B 9/00* (2006.01)

(52) U.S. Cl.
USPC ..... 52/126.6; 52/126.5; 52/220.1; 52/263

(58) Field of Classification Search
USPC ..... 52/126.5, 126.6, 220.1, 263, 302.1
See application file for complete search history.

(56) References Cited

U.S. PATENT DOCUMENTS 4,319,520 A * 3/1982 Lanting et al. ..... 454/290
4,596,095 A * 6/1986 Chalfant ..... 52/126.6
4,598,510 A * 7/1986 Wagner, III ..... 52/126.6
4,631,879 A * 12/1986 Kobayashi et al. ..... 52/98
5,758,457 A * 6/1998 Achen ..... 52/198
6,550,195 B1 * 4/2003 Cooper et al. ..... 52/220.3
7,546,715 B2 * 6/2009 Roen ..... 52/506.05
7,644,550 B2 * 1/2010 Meyer ..... 52/263
7,779,587 B1 * 8/2010 Meyer ..... 52/263
7,823,340 B2 * 11/2010 DeJonge et al. ..... 52/126.2
8,056,300 B2 * 11/2011 Meyer ..... 52/745.06
8,099,912 B2 * 1/2012 DeJonge et al. ..... 52/126.2
2002/0078638 A1 * 6/2002 Huang ..... 52/126.6
2009/0151271 A1 * 6/2009 Meyer ..... 52/126.6
2010/0281789 A1 * 11/2010 Vac ..... 52/126.5
2011/0041423 A1 * 2/2011 DeJonge et al. ..... 52/126.6

* cited by examiner

*Primary Examiner* — James Buckle, Jr.
(74) *Attorney, Agent, or Firm* — Scott L. Terrell, P.C.; Scott L. Terrell

(57) ABSTRACT

A raised access floor panel with a replaceable insert is provided. The panel includes a cross-braced framework constructed of four side rail members, and at least one cross-brace member. The cross-brace member is connected to the rail members so that the cross-brace member spans an area defined by the rail members. A plate frame is connected to an upper edge of the framework. The plate frame has a centroid void area which is surrounded by a peripheral portion. The peripheral portion includes an inner margin and an outer margin. The outer margin has right-angled corner forming portions. The inner margin is formed with a Z-section profile having a web portion which is capable of receiving the panel insert in fitment with the plate frame so that the insert and the peripheral portion are capable of providing a co-planar working surface.

10 Claims, 7 Drawing Sheets

RAISED ACCESS FLOOR PANEL WITH REPLACEABLE INSERT

CROSS REFERENCE TO RELATED APPLICATIONS

None.

STATEMENT OF FEDERALLY SPONSORED RESEARCH

Not applicable.

BACKGROUND OF THE INVENTION

1. Field of the Invention

The present invention relates to raised access floor panels. In particular it related to an interchangeable raised access floor panel having replaceable inserts for use in data centers.

2. Description of the Related Art

Raised floors are commonly used to create a space between a sub-floor and the normal working environment of a data center. The raised floor creates a separation barrier having an upper air plenum, which supports the server equipment, and a lower air plenum for receiving cooling air, which is recycled through the entire room of the data center. The lower air plenum is also used to contain the valves, pipes, fittings, gauges, fiber-optic cables, as well as the other design elements required for the efficient operation of the servers.

Raised floor panels are generally designed with a solid surface, a perforated surface, or with an air-grate. The air-grate panels are used to assist in circulating the cooling air through the plenums. The raised floor is supported on a matrix of pedestals, with one-each positioned under each corner of a floor panel. In a typical system, the support pedestal is a vertically disposed threaded rod. A first end of the support pedestal is threaded into a pedestal head, which supports a corner of the floor panel, and a second end of the pedestal support is threaded into a pedestal support base which is fastened to a floor of the building. In this manner, the support pedestal operates as a turnbuckle so that, by rotating the pedestal support, a vertical adjustment of the pedestal head, in relation to the subfloor, is achieved. The pedestal heads are connected in a matrix with horizontal stringers, and the stringers are used to support the edges of the floor panel plate.

In operation, data centers generate a great deal of revenue. Thus, it is often cost-prohibitive to shut down an entire facility in order to replace an existing floor system with an entirely new system of different manufacturers. When replacing an existing floor with a new floor one is often required to completely replace the entire existing floor structure because of the differently sized elements making up the component parts of the floor systems made by different manufacturers. An alternative has been to have the replacement panels custom made to fit with the existing systems. However, this alternative has all of the problems inherent with the use of custom manufactured products, including the inability to sustain an inventory of floor panels for immediate shipment and use. Thus, the production of interchangeable floor panels for use with new or existing systems of differing manufacturers have become increasingly desirable.

U.S. Pat. No. 7,644,550, to Meyer discloses an example of one such interchangeable panel which has gained wide acceptance in the industry. There, an articulating raised access floor panel, for interchangeable fit on new or existing pedestal support systems, is provided whereupon the open corner portions of the floor panel plate include an articulating corner bracket for expanding the foot-print of the panel. The bracket has an upper surface slidably connected to the lower plenum surface, so that the point of connection varies linearly along a diagonal vector established with respect to the lateral edges of the panel. This feature allows for installation of the interchangeable panel on different raised floor systems without experiencing issues related to the panels misalignment with those adjacent panels and stringers installed by other manufactures prior to installation. An additional feature disclosed with the Meyer discovery is the incorporation and use of a panel top set leveling screw, threaded through a collar portion of each bracket so that the panel is vertically adjustable for co-planar alignment with the adjacent panels and stringers. However, with the foregoing panels, one must replace the entire panel to change the working surface from a solid surface to and air-grate, for example, or remove the entire panel to view the conditions of the under-floor working environment where one is desires to monitor the meters, valves, or associated electrical components which are housed in the lower plenum in order to ensure the efficient operation of the systems.

Thus, while the foregoing interchangeable floor panels offer a great deal of utility, what is needed is raised floor access panel with a replaceable insert so that one need not remove, replace and reset the panel when simply to change the working surface configuration or view the lower plenum meters, valves and associated electrical components of the raised floor systems. Moreover, a need exists for an raised access floor panel with replaceable inserts, but which is also interchangeable for fitment with new or existing raised floor of differing manufacturers. The present invention satisfies these needs.

BRIEF SUMMARY OF THE INVENTION

It is therefore an object of the present invention to provide a raised access floor pane with replaceable working surface inserts.

It is another object of the present invention to provide an interchangeable raised access floor panel with replaceable working surface inserts and an expandable footprint.

It is another object of the present invention to provide an interchangeable raised access floor panel with replaceable inserts, and expandable foot print, and top set leveling legs.

It is yet another object of the present invention to provide and interchangeable raised access floor panel with a clear replaceable insert adapted for viewing the under floor components of a data center without removal of the panel.

To overcome the problems associated with the prior art and in accordance with the purpose of the invention, as embodied and broadly described herein, briefly, a raised access floor panel with a replaceable insert is provided. The panel includes a cross-braced framework. The framework has four side rail members, and at least one cross-brace member. The cross-brace member is connected to the rail members so that the cross-brace member spans an area defined by the rail members. A plate frame is connected to an upper edge of the framework. The plate frame has a centroid void area which is surrounded by a peripheral portion. The peripheral portion includes an inner margin and an outer margin. The outer margin has right-angled corner forming portions. The inner margin is formed with a Z-section profile having a web portion which is capable of receiving a working surface insert in removable fitment with the plate frame so that the insert and the peripheral portion are capable of providing a co-planar surface.

Additional advantages of the present invention will be set forth in the description that follows, and, in part, will be obvious from that description or can be learned from practice or testing of the present invention. the advantages of the invention can be fully realized and obtained by those apparatuses which are particularly pointed out in the appended claims.

BRIEF DESCRIPTION OF THE SEVERAL VIEWS OF THE DRAWINGS

The accompanying drawings, which are incorporated herein and which constitute a part of the specification, illustrate at least one embodiment of the present invention and, taken together with the description, explain the principles of the invention.

DETAILED DESCRIPTION OF THE DRAWINGS

Figure 1:
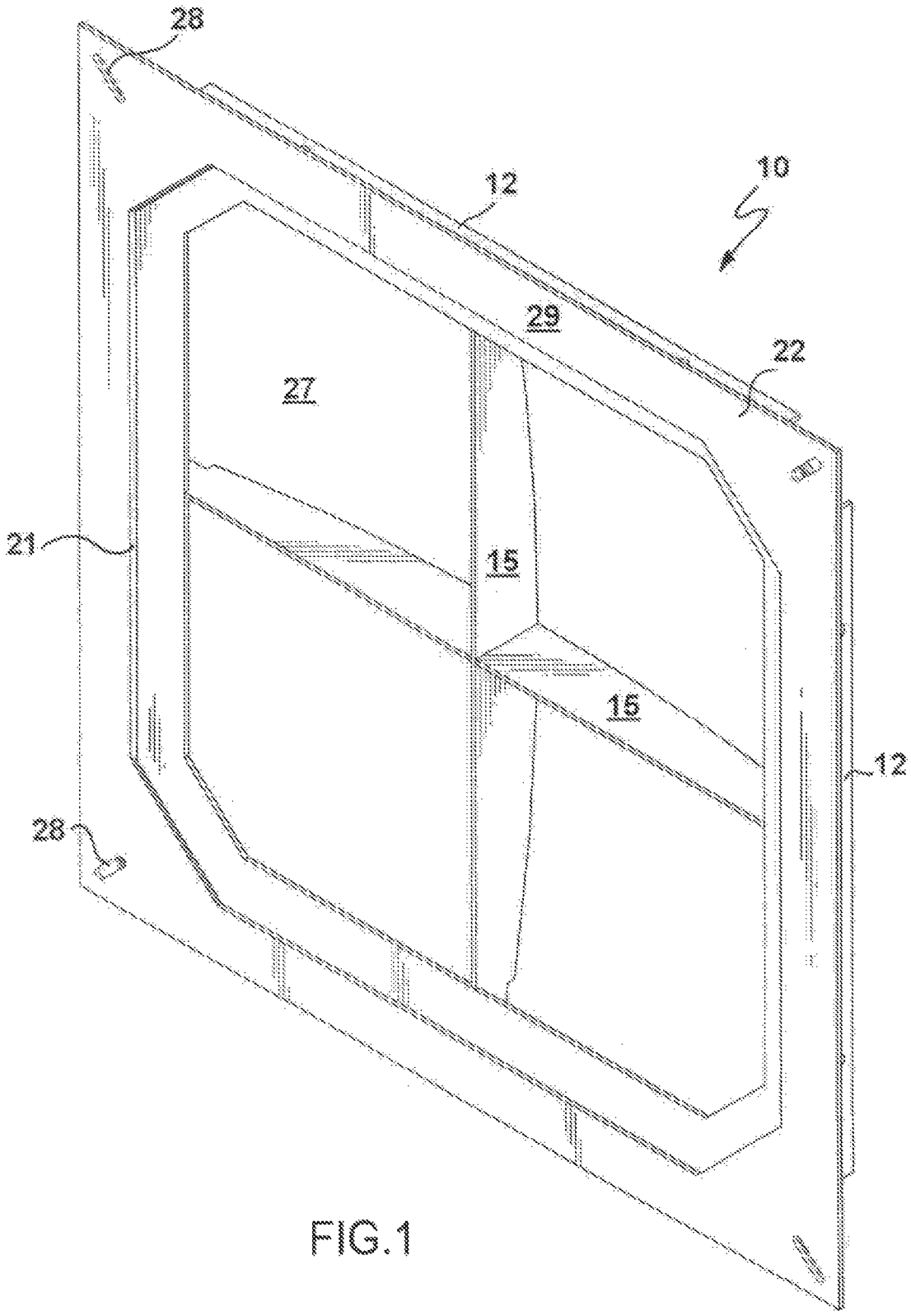
FIG. 1 is a perspective of the floor panel from the top-right corner, in accordance with the presently preferred embodiment, showing the clear replaceable insert for ease in viewing the under floor operational components in a data center.
Figure 2:
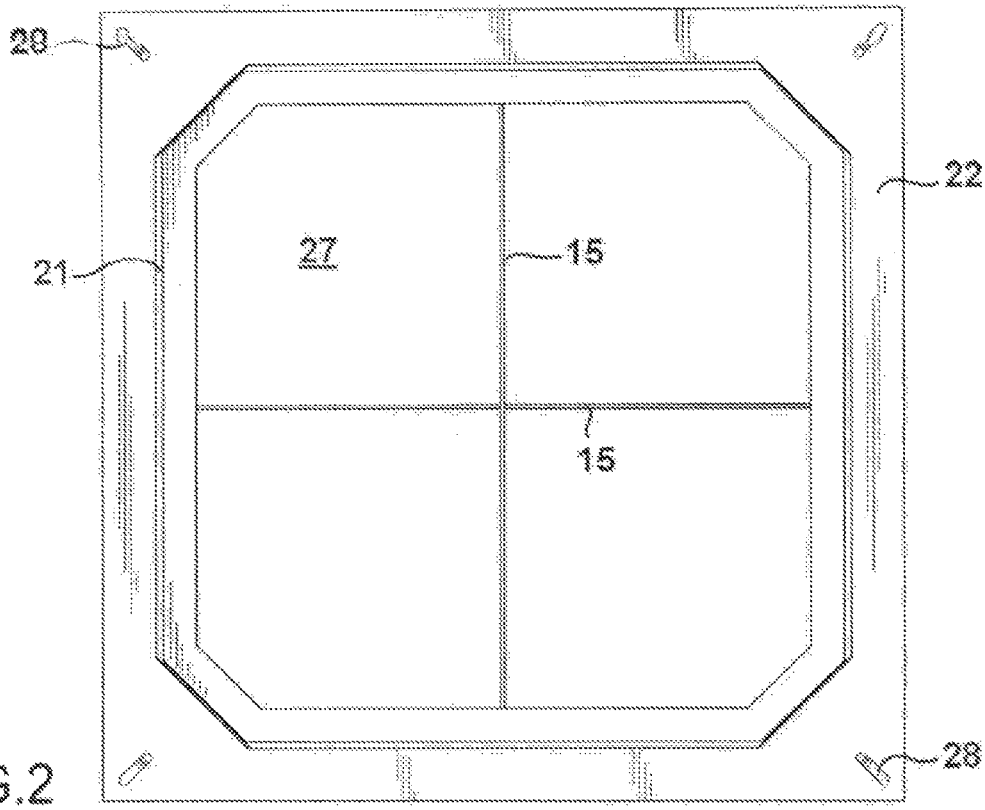
FIG. 2 is a top view of the presently preferred embodiment of the plate frame and framework built-up construction.
Figure 3:
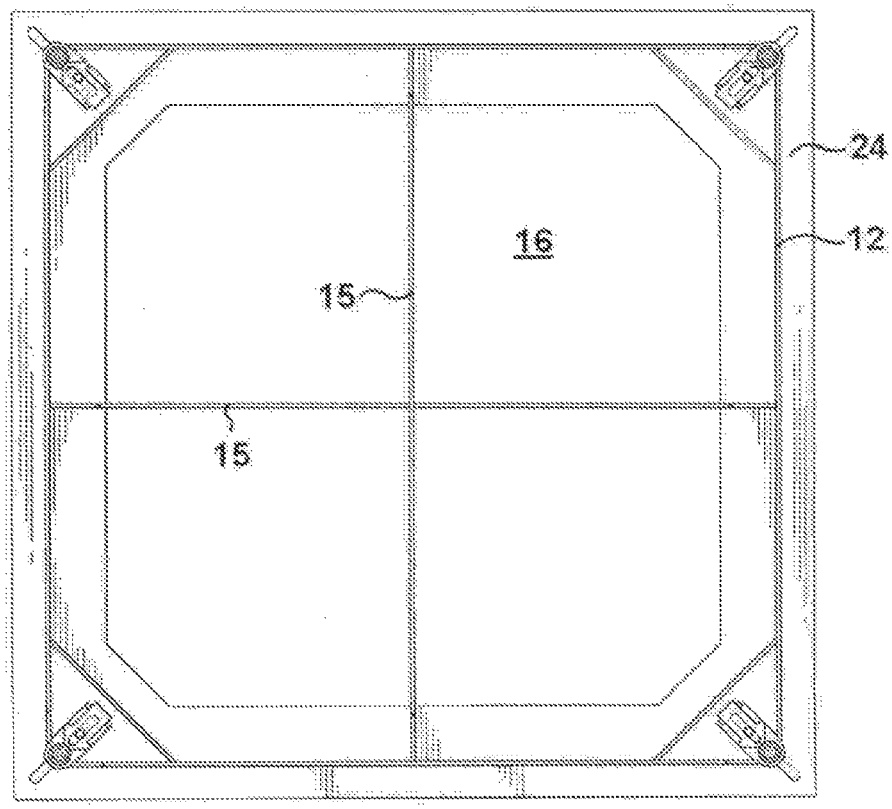
FIG. 3 is a bottom view of the floor panel in accordance with the presently preferred embodiment of the present invention.

Unless specifically defined otherwise, all technical or scientific terms used herein have the same meaning as commonly understood by one of ordinary skill in the art to which this invention belongs.

Although any methods an materials similar or equivalent to those described herein can be used in the practice or testing of the present invention, the preferred methods and materials are now described. Reference now will be made in detail to the presently preferred embodiments of the invention, examples of which are illustrated in the accompanying drawings, wherein like numerals represent like features of the invention.

The preferred embodiment of the present invention provides a raised access floor panel 10 with replaceable insert. The panel inserts 30 are selected from a group which consists of a solid top 32, clear polymer 36, air-grate 34, or lattice frame 38 constructions. In another preferred embodiment, the present invention provides a raised access floor panel 10 with replaceable inserts 30 and a foot-print-expanding bracket 40. The bracket 40 is capable of extending the floor panel's foot-print so that the panel 10 can be used on different raised floor systems 60 without experiencing misalignment problems relative to installation of the floor panel 10 the adjacent floor panels and stringers 68. In yet another presently preferred embodiment of the present invention, the invention provides a raised access floor panel 10 with replaceable inserts 30, a foot-print expanding bracket 40, and top set leveling screws 48.

The raised access floor panel 10 has a cross-braced supporting framework. The framework is a ridges steel build-up member constructed of thin rectangular steel plates. The steel plate stock used in the construction of the framework is desirably greater than 6.35 mm in thickness. The cross-braced framework is preferable constructed with four thin rectangular plate lateral side rail members 12. The rail members 12 are connected at ends thereof with four thin rectangular diagonal knee brace members 14. In this manner, the side rail members 12 and diagonal knee brace members 14 define a framework having an interior open area 16, which is octagonal in shape, and four generally triangular corner sections 18. The frame rails 12 are also constructed so that rails 12 includes a plurality of clear holes 13 formed in an evenly spaced apart relationship which are capable of circulating an air flow, between adjacent floor panels, and with notched end portions adapted for use with the articulating bracket 40 and leveling assemblies, described below.

The open octagonal area 16 is spanned with at least one cross-brace member 15. However, in the presently preferred embodiment, it is desirably to support the framework against a load bearing force with at least two cross-brace members 15 connected at the ends thereof to oppositely aligned side rails 12 so that the cross-brace members 15 intersect at a centroid of the octagonal open area 16. In addition, the cross-brace members 15 are also desirably formed from thin rectangular steel plates cut in a parabolic shape so and connected, relative to the framework, so that the curvature portion of the shape defines the lower edge of the cross-brace members 15.

A steel plate frame 20 is connected to an upper edge of the framework so that a rigid built-up construction of the framework and plate frame is capable of supporting the replaceable insert 30 under an applied load condition. The plate frame 20 is preferable constructed from a heavy steel plate stock, having a thickness greater than 5.0 mm, so that an octagonal centroid void portion 27 is surrounded by a peripheral portion 29. The peripheral portion 29 defines both inner and outer margins. The outer margin has lateral edge formations which taken together define right-angled corner forming portions 26. The inner margin forms a Z-section profile having a web portion 21 which is adapted for fitment of the replaceable floor panel inserts 30 into a construction whereby the insert 30 and the peripheral portion 29 are capable of providing a co-planar working surface. In the presently preferred embodiment, both the centroid void area 27 and replaceable inserts 30 are configured in complimentary octagonal shapes. This complimentary shaped configuration, of the inner margin and insert, acts to enhance the load bearing characteristics of the floor panel, and to resist lateral movement of the insert 30 within the web portion 21 of the Z-section profile. The cross-braced framework and steel plate frame construction is desirably finished with a powder coating having a thickness in the range of 3-5 millimeters. The finish is desirably formulated with a conductive or non-conductive epoxy or urethane materials. The finish may, but need not, further include other compositions which are specific to a desired chemical resistance or having slip-resistant resistant characteristics, depending on the intended use.

Figure 4:
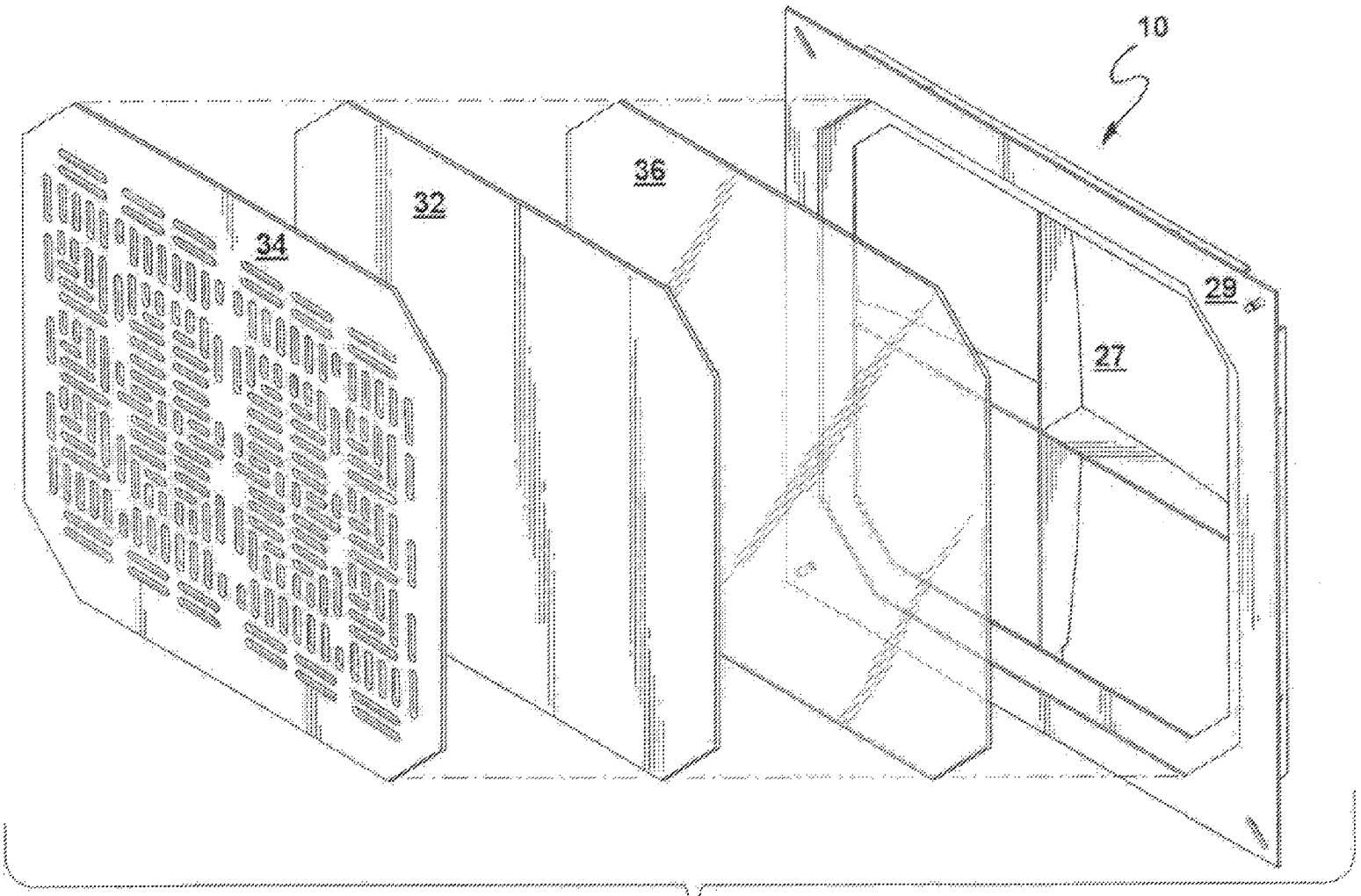
FIG. 4 is an exploded view, of the presently preferred embodiment, showing the variety replaceable working surface inserts contemplated for use in the practice of the present invention.

Turning now to FIG. 4, it is shown the alternative embodiments of the replaceable panel inserts 30 adapted for use with the built-up plate frame and framework member. As above, the removable inserts 30 are desirably octagonal in shape. The inserts are configured as a clear polymer sheet 36, an air-grate plate 34, a solid surface 32, or a lattice braced frame 38. In addition, to providing the air-grate 34 and solid surface 32 configurations, the present invention provides a novel working surface in the form of a clear polymer insert 36 which is scratch and or ultraviolet resistant. The clear polymer insert 36 is particularly desirable for use in viewing the meters, gauges, valves, and electrical components housed in the under-floor plenum of a data center. The surface of the clear insert 36 is scratch resistant to foot traffic, and when installed in situ, is designed to be capable of withstanding a concentrated load up to 680.4 kg while being versatile enough to be adjusted vertically, or horizontally, to flush mount to most Imperial or Metric raised floor systems, regardless of age. The clear view™ panels 36 are primarily intended for use in foot traffic areas, and not for use in supporting equipment, or rolling loads. The solid surface replaceable insert 32 is adapted for use in those heavy and rolling load applications.

Figure 10:
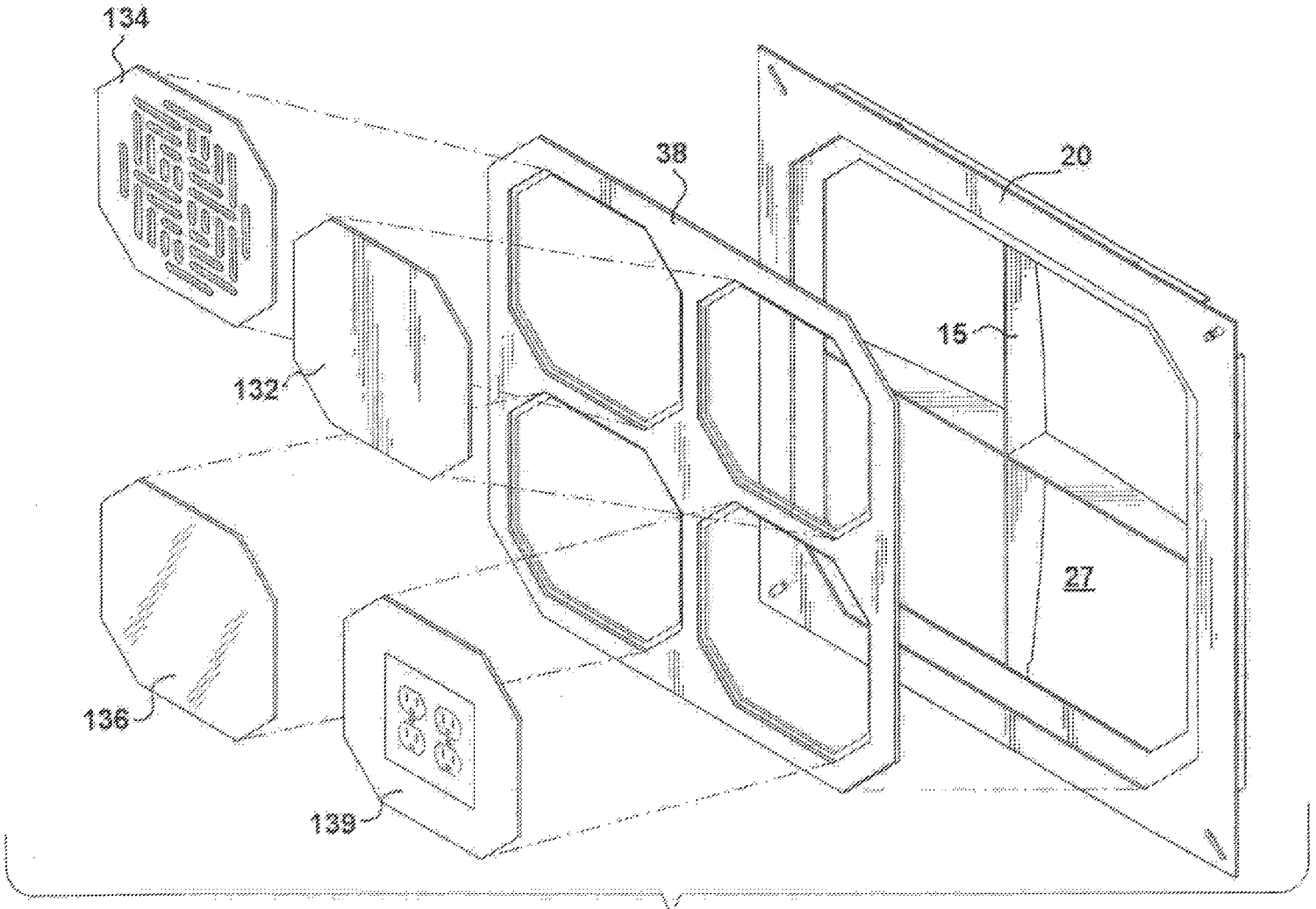
FIG. 10 is a perspective view of the lattice braced replaceable insert, according to yet another preferred embodiment of the present invention, whereby the lattice braced insert is adapted to receive four sub-inserts, including an utility box.

Referring now to FIG. 10, the lattice braced sub frame insert 38 includes at least two open void portion 39, but is shown in the presently preferred embodiment with four openings 39. The openings 39 are also formed with the Z-section profile, described above, so that the openings 39 are capable of securing the sub-inserts. The sub-inserts may, but need not, be of a kind which is the same, or similar to the foregoing examples, or may further include a sub-insert adapted as a housing for utility access, as an electrical box 139 or data ports (not shown), such as a USB port for linking to air flow meters or temperature gauges for real-time data display of the operational parameters.

Figure 5:
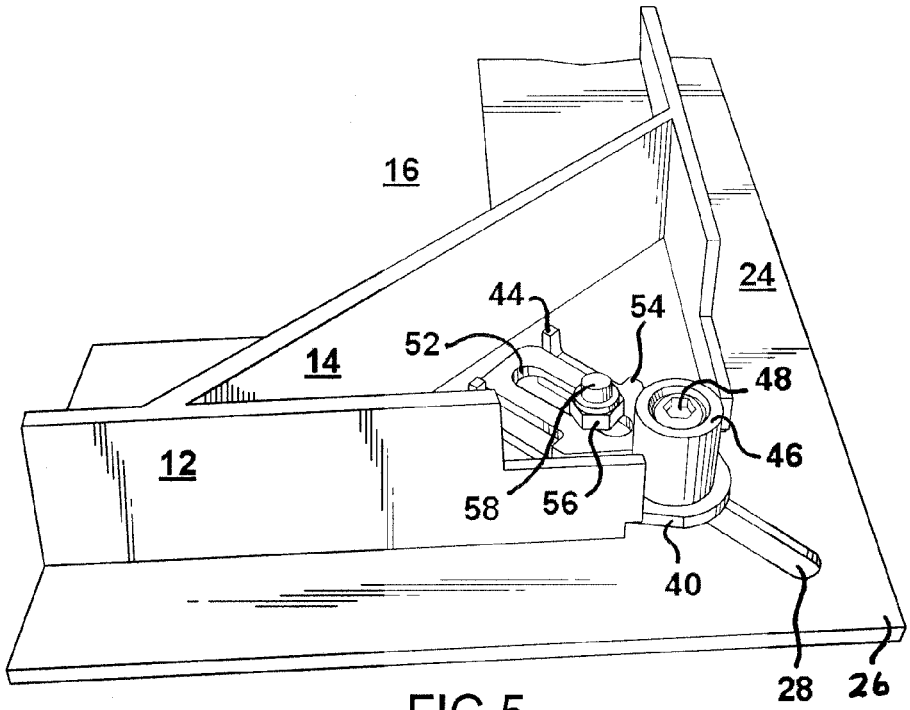
FIG. 5 is a perspective view, from the lower left hand corner of the presently preferred embodiment of the articulating corner bracket and top set leveler assembly.
Figure 6:
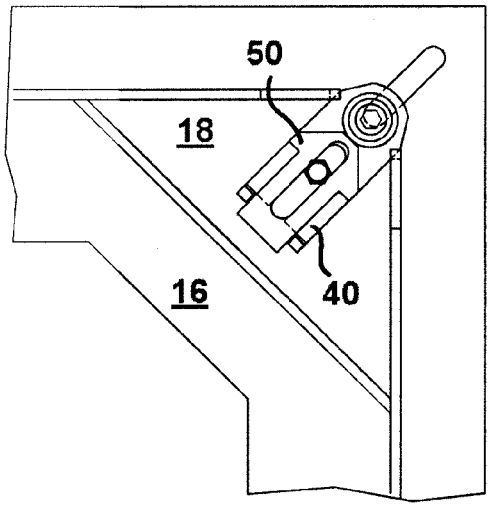
FIG. 6 is a bottom view of the panel top set leveling assembly showing the bracket adjusted in an inboard position which effectively reduces to foot-print of the floor panel.
Figure 7:
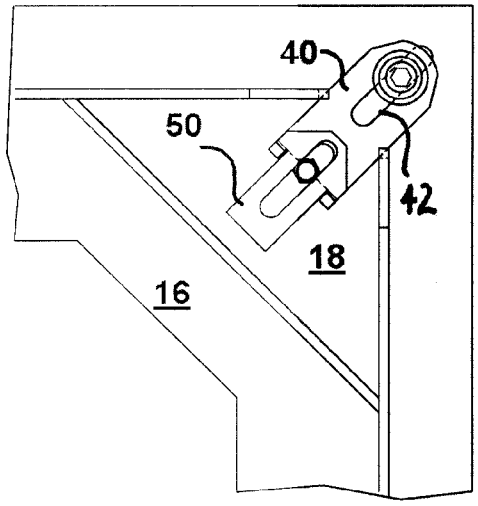
FIG. 7 is a bottom view of the panel top set leveling assembly showing the bracket adjusted in an outboard position which effectively expands to foot-print of the floor panel.
Figure 8:
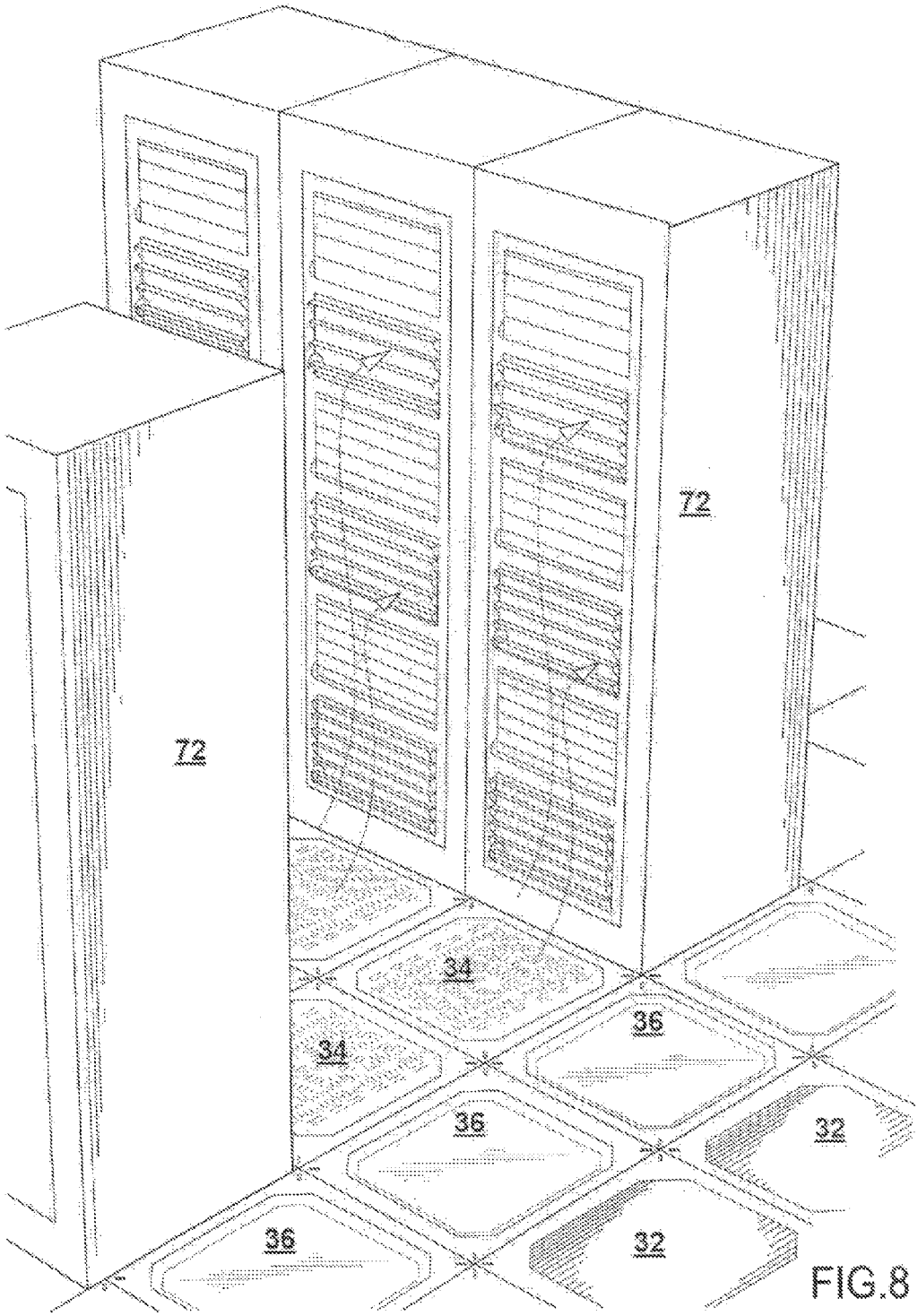
FIG. 8 is a perspective view from the upper plenum of a data center showing the raised access floor panels for use in combination in creating a raised floor acting as an air separation barrier and a supporting surface for the server systems. Here, the air-grate insert panels are preferable positioned in front of the server racks for establishing a cold-aisle useful in circulating a cooling air flow through the server racks. The clear insert panels are shown in an installation which establishes a periphery around the server racks so that one is able to easily monitor the temperature and air-flow sensors, and meters for efficient temperature and air-flow management of the system. Solid surface insert panels are desirably located at various positions through out the remainder of the raised floor to illustrated their use for either for aesthetic appearance, or for in those areas where it is necessary to support a heavier load, such as a rolling load.
Figure 9:
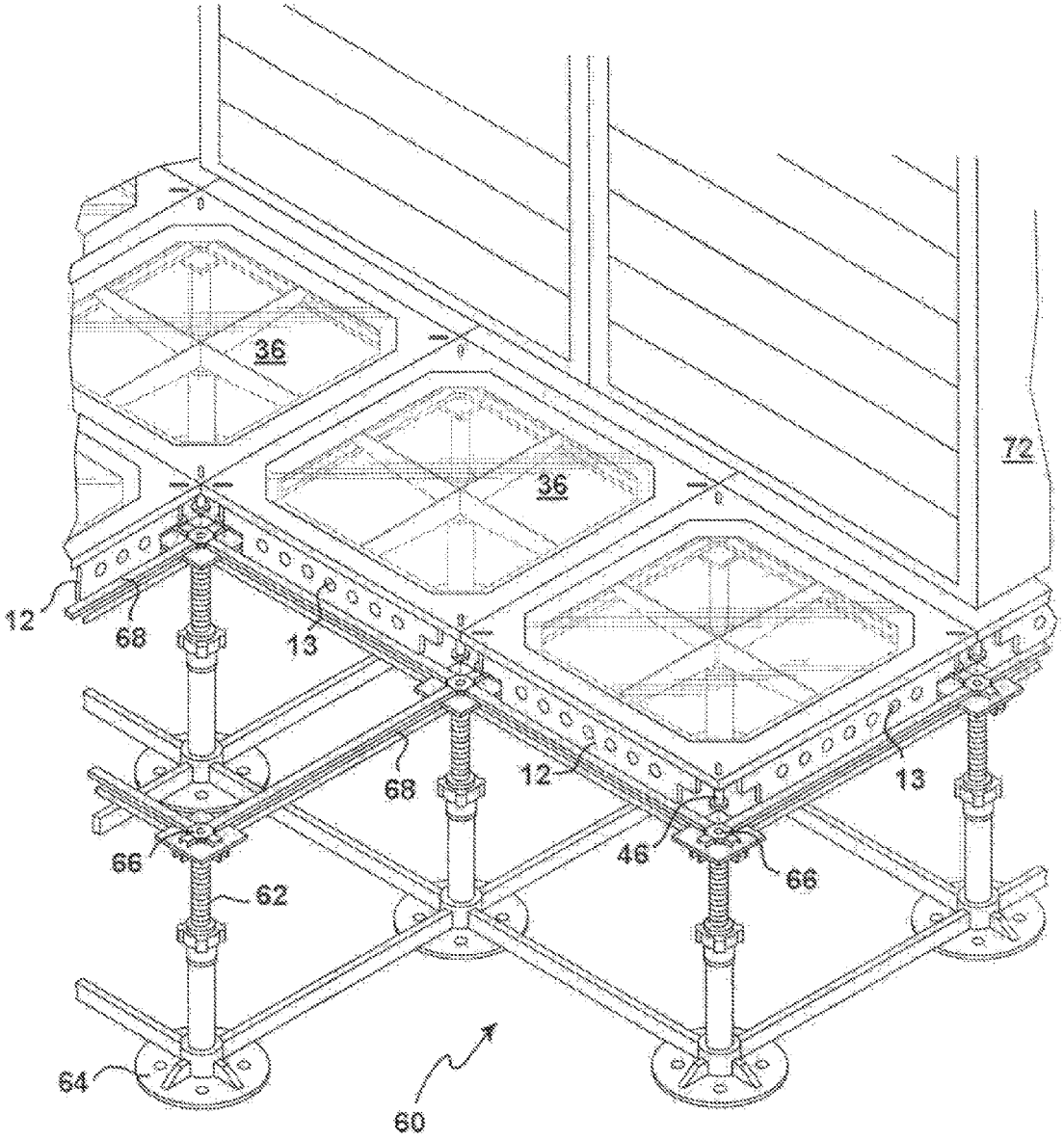
FIG. 9 is a perspective illustration of the interchangeable floor panels, in accordance with the presently preferred embodiment of the invention, where the raised access floor panels are fitted with the clear replaceable inserts and top set leveling screws. The leveling screws are shown in an adjustment which biases the leveling screws against the pedestal heads, of a pedestal support system, creating a co-planar floor which allows for ease in viewing of those portions of the under floor environment adjacent to a server rack.

Referring now to FIGS. 5-7, yet another embodiment of the present invention is disclosed. Here, the corner forming portions 26 each include a diagonal clear slot 28 cut through the plate frame 20. The diagonal clear slots 28 are positioned along a diagonal vector relative to the lateral edges of the plate frame 20 peripheral portion 29. In addition, the rail 12 ends are notched and the plate frame 20 is adapted to slidably connect a foot-print-expanding bracket 40 to the lower surface 24 of the plate frame, at each of the corner forming portions 26, with a stud 58, or bolt, and a nut 56. The bracket 40 is slidably connected so that the bracket 40 is capable of linear travel along the diagonal vector for eventual compression fit with a clamping member 50 used to secure the bracket 40 against the lower surface 24 in a predetermined position. The bracket 40 is thereby capable of reducing or extending the foot-print, of the panel 10, along the diagonal vector so that the floor panel 10 can be used with new or existing raised floor systems 60 without experiencing misalignment in relation to the adjacent floor panels or stringers.

The articulating bracket 40 is a horizontal sheet construction with proximal and distal portions. The distal portion includes a downwardly extending cylindrical member 46 which is adapted to bias against, but not attach to, the pedestal head 66 of a pedestal support system 60. The proximal portion has a central clear slot 42 extending along the diagonal vector, and is connected to the lower surface 24 of the floor panel 10 with a clamp 50. The clamp 50 is also a sheet construction with an inner face which slidably engages an outer face of the bracket 40. The clamp 50 is formed with a central slotted opening 52 in axial and complimentary alignment with the diagonal clear slots 42, 28 of the bracket 40 and plate frame 20. A proximal portion of the clamp 50 is fastened to the lower surface 24 of the floor panel plate 20, between the knee brace member 14 and the rail ends 12 of the support frame, with a 10 mm lock nut 56 threaded onto a bolt, or externally threaded stud 58, extending downwardly from the lower panel surface 24 through the clear slot 52 in the clamp 50. In this manner, both the clamp 50 and the bracket 40 slide in a linear fashion along the diagonal vector for adjustment, and, upon tightening of the lock nut 56 once the clamp 50 and bracket 40 are located in the predetermined positioned, the clamp 50 creates a compression fit for securing the bracket 40 in the predetermined position between the lower surface 24 of the plate frame 20, the clamp 50, and the proximal end of the bracket 40.

The clamp 50 and bracket 40 members may, but need not, also include features which are adapted to limit outboard travel of the bracket 40 along the diagonal vector. Here, the distal end of the clamp is formed to include laterally extending protrusions 54. The protrusions 54 have proximal and distal engaging surfaces. The distal engaging surfaces are capable of biasing against the inner walls of the steel frame rail 12 plate ends, and the proximal end of the bracket 40 is formed with lateral flange portions 44 which engage the proximal engaging surfaces of the lateral protrusions 54 of the clamp 50. Once engaged, the distal engaging surfaces of the lateral protrusions 54 stop the clamp 50 against the inner walls of the frame rails 12, and the flanges 44 stop outboard travel of the bracket 40 against the clamp 50 proximal engaging surfaces of the protrusions 54 so that travel of the clamp and bracket 40 is limited to a distance defined by the diagonal clear slot in the plate frame 20. In yet another preferred embodiment of the present invention, the floor panel 10 includes top set leveling screws 48 for precise adjustment of the horizontal plane of the panel 10 once it is installed adjacent to other floor panels or stringers 68. With this embodiment, the foot member 46 is a vertically extending collar having an internally threaded clear hole adapted to receive a top set leveling screw 48, or bolt. The top set leveling screw 48 includes a tool operating end for receiving a 5 mm Allen wrench and a foot end formed to securely bias against, but not attach to, the pedestal head 66 of an existing pedestal support system 60. The top set leveling screw 48 is operated by engaging the tool receiving end with the Allen wrench through the diagonal clear slot 28 from the upper surface 22 of the panel 16, and turning the wrench in a clockwise, or counter-clockwise, directions for precise adjustment of the upper surface 22 so that it is on-plane with the adjacent panels or stringers 68.

While the present invention has been described in connection with the illustrated embodiments, it will be appreciated and understood that modiciations may be made without departing, from the true spirit and scope of the invention.

I claim:

1. A raised access floor panel, comprising (a) a cross-braced sub-framework having four side rail members, and at least one cross-brace member, said cross-brace member connected at opposite ends thereof to the rail members so that the cross-brace member spans a central void area having a perimeter defined by the rail members;

(b) a removable floor panel insert having a predetermined thickness and an upper working surface, said insert capable of supporting a downward load bearing force; and (c) a plate frame having a peripheral top plate surrounding a void centroid portion, wherein said peripheral top plate is connected at a lower surface thereof to an upper edge of said side rail members, and includes an inner margin, and outer margins, and an upper horizontal working surface, wherein said inner margin is formed with a web having a Z-section profile, said Z-section profile having a vertical face dimension which is substantially equal to the predetermined thickness of the insert so that the web is capable of receiving the insert in tight press fitment with the top plate and wherein the upper working surfaces of the insert and top plate are co-planar when supporting the load bearing force.

2. The raised access floor panel according to claim 1, wherein the centroid portion is an octagonal shape.

3. The raised access floor panel according to claim 1, wherein the side rail members are thin rectangular plates.

4. The raised access floor panel according to claim 1, wherein the insert is selected from a group consisting of a clear polymer sheet, an air-grate plate, and a solid surface.

5. The raised access floor panel according to claim 1, wherein a lower margin of the cross-brace member is substantially parabolic in shape.

6. The raised access floor panel according to claim 1, wherein said cross-brace is a unitary crisscross-brace member connected at opposite ends thereof to oppositely aligned side rails so that the crisscross-brace members has crossing point at a centroid of the central void area defined by the sub-framework rail members.

7. The raised access floor panel according to 1, wherein said insert is a lattice braced second plate frame adapted to receive at least two removable sub-inserts.

8. The raised access floor panel according to claim 1, further comprising four diagonal knee brace members, wherein said side rail members are connected by the diagonal knee brace members so that the side rail members and diagonal knee brace members define the perimeter of the central void area of the sub-framework, so that said central void area is octagonal.

9. The raised floor panel according to claim 1, wherein at least one of the side rails includes a plurality of clear holes in a linear spaced relationship capable of circulating an airflow between adjacent floor panels in a raised access floor system.

10. The raised floor panel according to claim 7, wherein the sub-insert is selected from a group consisting of a junction box, a clear polymer sheet, an air-grate, and a solid body.

* * * * *